United States Patent [19]

Lambiris

[11] 3,986,817

[45] Oct. 19, 1976

[54] GRID BURNER PILOT IGNITER

[75] Inventor: Sotiris Lambiris, Andover, Mass.

[73] Assignee: General Electric Company, Schenectady, N.Y.

[22] Filed: Apr. 9, 1975

[21] Appl. No.: 566,408

[52] U.S. Cl. ..... 431/264; 431/285; 431/351; 431/353; 239/404; 239/405; 432/222

[51] Int. Cl.[2] ..... F23Q 3/00; F23D 15/00

[58] Field of Search ..... 431/173, 174, 175, 285, 431/351, 353, 182, 183, 352, 264; 432/222, 223; 239/404, 405; 60/39.74 R

[56] References Cited

UNITED STATES PATENTS

| | | | |
|---|---|---|---|
| 1,910,735 | 5/1933 | Zikesch | 431/173 |
| 2,285,704 | 6/1942 | Frank | 431/175 |
| 2,538,953 | 1/1951 | Yates et al. | 432/222 |
| 2,967,224 | 1/1961 | Irwin | 431/285 |
| 3,826,079 | 7/1974 | Quig et al. | 60/39.74 R |
| 3,830,620 | 8/1974 | Martin | 431/350 |

*Primary Examiner*—Carroll B. Dority, Jr.
*Attorney, Agent, or Firm*—James W. Mitchell; John F. Ahern

[57] ABSTRACT

A wall burner is described for firing a flame laterally into a duct of the type generally known as a waste heat recovery duct wherein hot exhaust gases are passed in a heat exchange relationship with a second fluid downstream from the wall burner. The wall burner may be used as an igniter for a grid burner system disposed within the duct or the wall burner may itself be used to reheat the hot exhaust gases. The wall burner includes a combustion chamber pipe and ignition means located outside the duct so that ignition occurs outside the duct thereby obviating instabilities inherent in trying to ignite a combustible mixture within the hot exhaust gas path.

2 Claims, 4 Drawing Figures

GRID BURNER PILOT IGNITER

BACKGROUND OF THE INVENTION

This invention relates, in general, to devices for firing a flame laterally into a waste heat recovery duct; and, in particular, this invention relates to a pilot burner igniter to be used in combination with a grid burner system disposed in a waste heat recovery duct.

A waste heat recovery duct is used to channel hot exhaust gases; for example, from a gas turbine, to a heat exchange tube bundle located within the duct for the purpose of heating a second fluid; for example, steam or a process fluid thereby utilizing a heat source which would otherwise be wasted. When a gas turbine and a steam turbine are each connected to a generator for producing electrical power and the gas and steam turbines are interconnected by a heat recovery steam generator, the system is known as a combined cycle power plant.

Since the flow volume and temperature of the gas turbine exhaust gas may vary, it is sometimes necessary to provide for supplementing firing, that is, to provide an alternative heat source for raising the exhaust gas temperature within the waste heat recovery duct. One means for providing this additional heat is to provide a grid burner system within the waste heat recovery duct, downstream from the hot exhaust gas source and upstream from the heat exchange tube bundle. Such a grid burner system is shown in U.S. Pat. No. 3,830,620 to Martin issued Aug. 20, 1974 and incorporated herein by reference.

Briefly described, a grid burner system employs a plurality of main burners which are mounted across the waste heat recovery duct and provide a combustible mixture into the duct. In order to ignite the main burner combustible mixture a lesser number of pilot burners are provided downstream from and transverse to the main burners, the pilot burners also providing a combustible mixture. In each case, the combustible mixture may be air and oil or air and gas. In order to ignite the pilot burners which in turn ignite the main burners, it has been the practice to insert a specially constructed, elongated, spark plug into the duct through a port formed in the duct wall, one spark plug for each pilot burner. The tip (spark plug terminals) of the spark plug would be disposed closely adjacent the pilot burner so that ignition would occur within the duct and flame would propagate from the duct wall into the center of the duct.

It is sometimes difficult to cause firing within the waste heat recovery duct according to the prior art. For example, the initial combustion flame may be unstable due to the velocity of the hot exhaust gases within the waste heat recovery duct. Moreover, the spark plug itself may become fouled due to an oil-rich atmosphere occurring within the waste heat recovery duct.

It is one object of the present invention to provide a pilot burner igniter for a waste heat recovery duct wherein initial combustion occurs outside the duct walls of the waste heat recovery duct.

It is another object of the present invention to provide a pilot burner igniter for a waste heat recovery duct wherein the ignition means is located outside the waste heat recovery duct walls.

It is a further object of the present invention to provide a device for firing a flame laterally into waste heat recovery duct.

According to the foregoing objects of the invention, a port is supplied through the wall of a waste heat recovery duct. A wall burner comprising concentric fuel and air supply pipe manifolds includes a nozzle portion for introducing the fuel and air into a combustion pipe. An ignition means or spark plug is also introduced into the combustion pipe for igniting a combustible mixture of gas and air within the combustion pipe. The combustion pipe is concentric within the air manifold pipe so that the outlet ends of both the air manifold pipe and the combustion pipe are directed into the port through the duct wall. Ignition occurs within the combustion pipe outside the duct and a flame is sent from the combustion pipe so that it enters the duct laterally through the port in the duct wall.

The novel features believed characteristic of the present invention are set forth in the appended claims. The invention itself, however, together with further objects and advantages thereof, may best be understood with reference to the following description, taken in connection with the appended drawings.

DETAILED DESCRIPTION OF THE INVENTION

Figure 1:
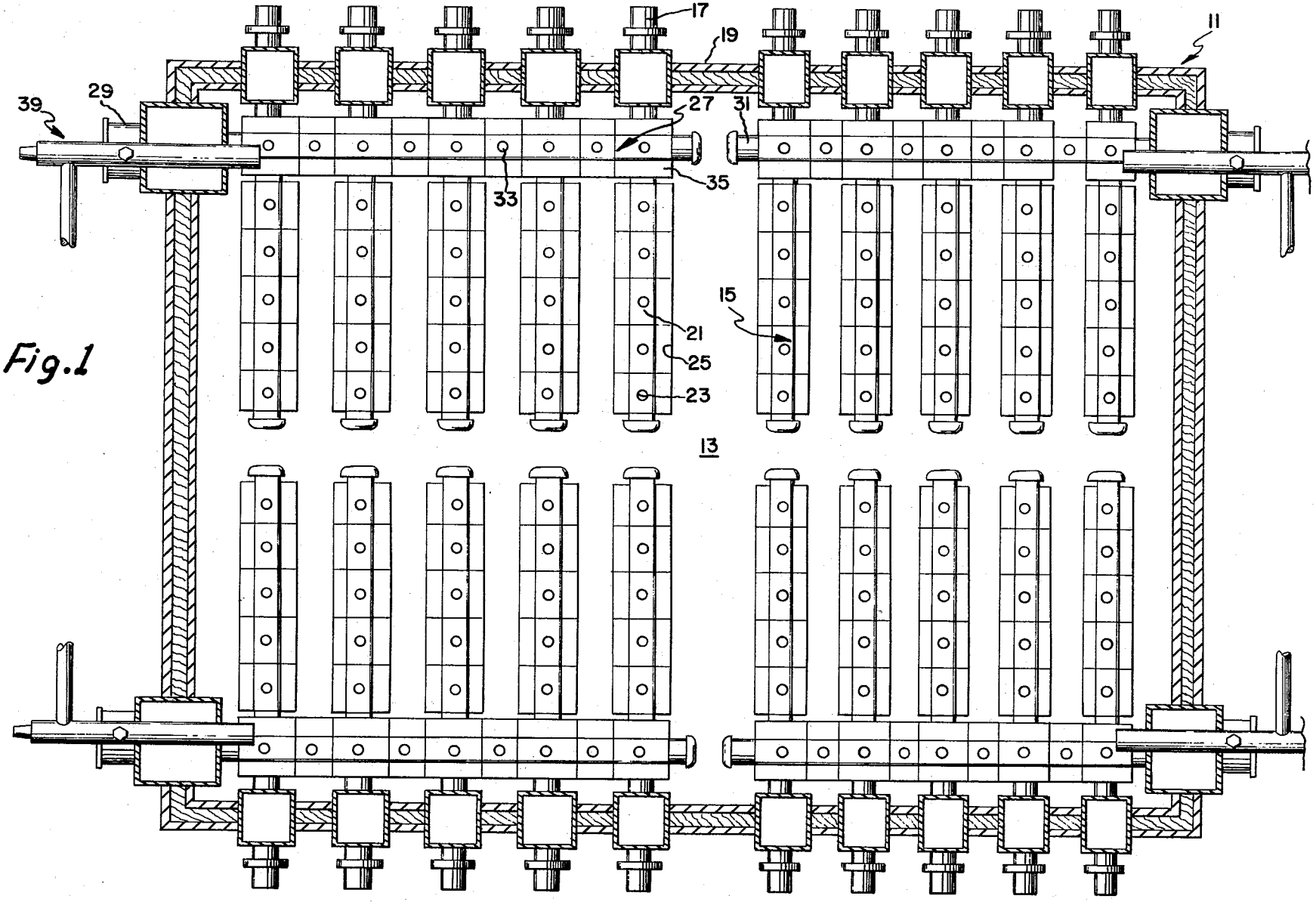
FIG. 1 is a plan cross-section view of a waste heat recovery duct.

Referring to FIG. 1, a waste heat recovery duct 11 is shown, the duct being the type which would interconnect a hot exhaust gas source with a heat exchange module. A grid burner system 13 is disposed within the duct and is downstream from the hot exhaust source and upstream from the heat exchange module. The foregoing constitutes a waste heat duct with supplementary firing and is well known in the prior art.

The grid burner system includes a plurality of main burner elements 15 each comprising an air and fuel manifold 17 attached to a duct wall 19 and having a distribution pipe 21 attached at one end to its manifold pipes and extending across the duct toward an opposite duct wall. Each distribution pipe has a plurality of orifices 23 along the length of the pipe from which a combustible mixture of fuel and air is ejected. Baffles 25 are attached to each distribution pipe so that the upwardly flowing exhaust gas is diverted from the area immediately downstream from the orifices 23 to define a low-pressure region about the orifices.

Transverse to the main burners and downstream with respect to the exhaust gas flow there are a number of pilot burners 27. Each pilot burner includes a fuel and gas manifold 29 which is connected to a distribution pipe 31. Each distribution pipe includes a plurality of orifices 33 and further includes baffles 35.

Figure 2:
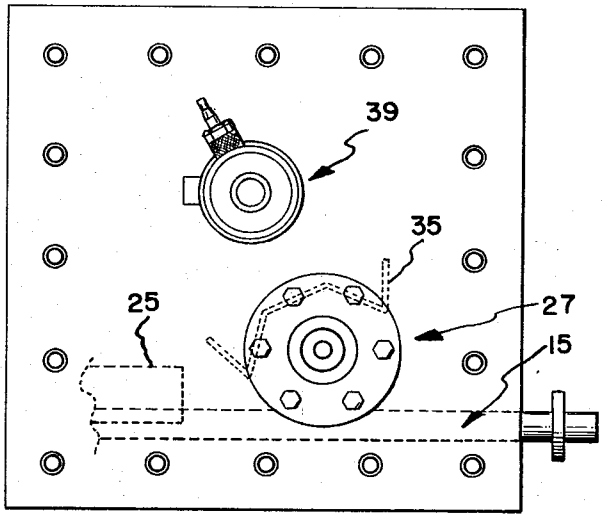
FIG. 2 is an enlarged elevation view of one corner of a waste heat recovery duct showing the disposition of a main burner, a pilot burner and an igniter according to the present invention.

Referring to FIG. 2, in combination with FIG. 1, a wall burner 39 employed as a pilot burner igniter is disclosed in relation to the pilot burner 27 and the main burner 15. In operation, the main burner 25 shoots a substantially vertical combustible mixture to be combined with a second combustible mixture from the pilot burner, both mixtures overlapping in a region adjacent the outlet of the pilot burner igniter 39 to be ignited by a flame provided by the igniter in a manner hereinafter described.

Figure 4:
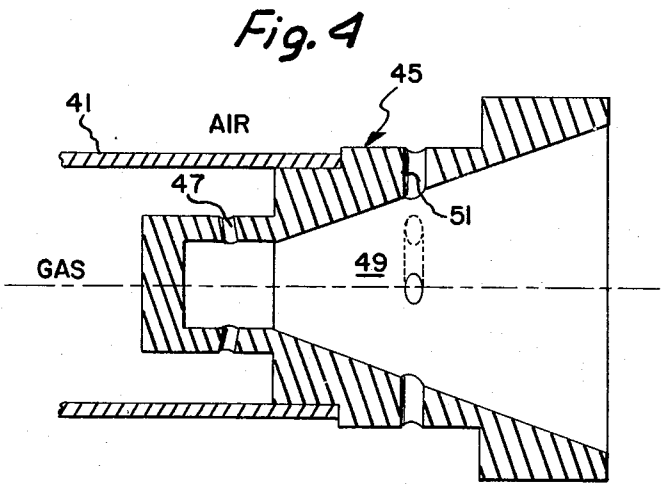
FIG. 4 is a cross-section elevation view of a nozzle incorporated into the present invention.
Figure 3:
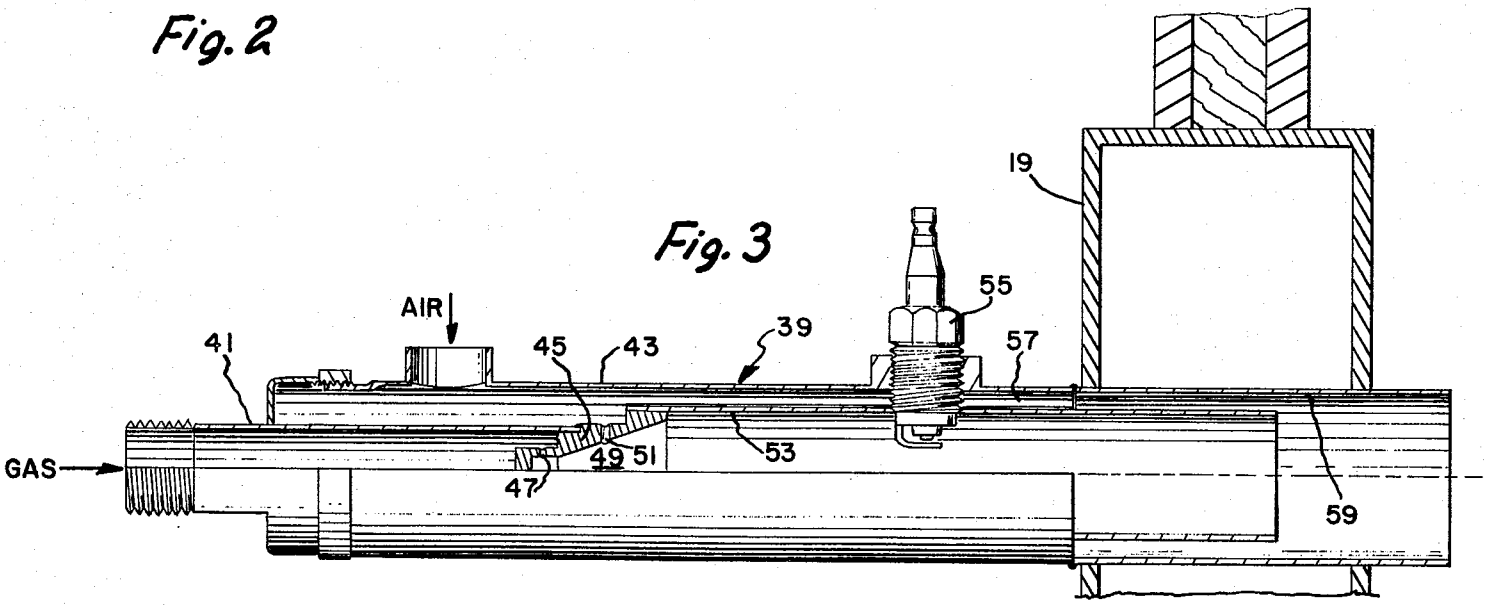
FIG. 3 is a quarter-section elevation view of a wall burner according to the present invention.

Referring to FIGS. 3 and 4, a wall burner according to the present invention is described. A gas supply manifold pipe 41 is concentrically mounted within an air supply manifold pipe 43, the inlets to each designated with an arrow indicating gas and air respectively. The outlet end of the gas manifold pipe is attached to a nozzle 45. The nozzle 45 is formed with a plurality of gas admission holes 47 (only two shown) communicating the interior or mixing chamber 49 of the nozzle with the gas manifold pipe. The outlets of the gas admission holes are generally tangential to the axi-symmetric cross section of the nozzle interior so that a circumferential movement is imparted to the gas as it is admitted to the interior of the nozzle.

Likewise, air is admitted to the interior of the nozzle through a plurality of air admission holes 51 (several shown) communicating the interior or mixing chamber 49 of the nozzle with the air manifold pipe. The outlets of the air admission holes are generally tangential to the axi-symmetric cross section of the nozzle interior so that a circumferential movement is imparted to the air as it is admitted to the interior of the nozzle.

The air envelops the gas within the interior of a combustion pipe 53 attached to the outlet end of the nozzle. The combustion pipe is concentric within the air manifold pipe and an ignition means 55 is inserted radially into the combustion pipe. The ignition means may be a spark plug. The ignition means ignites the combustible mixture of air and gas causing a flame to be emitted at the outlet end of the combustion pipe 53. Once combustion is initiated, the spark plug energy is no longer necessary.

The duct wall 19 is formed with a through port 59 which may include a pipe liner made of Inconel. In one preferred embodiment, the air manifold pipe is welded to the outside of the duct wall in register with the wall port whereas the combustion pipe extends partly into the port. An annular space 57 is defined between the air manifold pipe and combustion pipe inner and outer diameters, respectively, to bathe the combustion pipe with cooling air and to supply the emitted flame with combustion air at the termination or outlet end of the combustion pipe. In any event combustion is initiated outside of the heat recovery duct so as to introduce a stable flame into the duct.

As it has been shown, in the preferred embodiment, the wall burner 39 is used in combination with a grid burner system as an igniter. However, it is possible to use the wall burner for heating the duct exhaust gas directly by increasing the size of the wall burner 39. Also, the length of the flame emitted from the combustion chamber may be varied by adjusting the fuel pressure of the gaseous fuel. Finally, the wall burner may be adjusted for firing liquid fuel by substituting a well known liquid fuel nozzle for the nozzle shown without departing from the scope of the claimed invention.

While there is shown what is considered, at present, to be the preferred embodiment of the invention, it is, of course, understood that various other modifications may be made therein. It is intended to claim all such modifications as fall within the true spirit and scope of the invention.

What is claimed is:

1. An igniter comprising:

an outer pipe having an inlet connected to an air supply;

an inner pipe concentrically mounted within said outer pipe, said inner pipe having an inlet connected to a fuel supply;

a combustion pipe concentrically mounted within said outer pipe and co-axial with said inner pipe;

a nozzle mounted within said outer pipe and co-axial with said inner pipe and said combustion pipe, said nozzle interconnecting the outlet end of said inner pipe with the inlet end of said combustion pipe; said nozzle having an interior chamber to define an axi-symmetric mixing chamber for forming a combustible mixture of fuel and air; said nozzle further comprising a plurality of fuel inlet holes substantially tangential to the mixing chamber and, said nozzle comprising a plurality of air inlet holes substantially tangential to the mixing chamber whereby circumferential movement is imparted to the fuel and air respectively, said fuel and air inlet holes communicating with said inner and outer pipes respectively; and, ignition means for igniting said combustible mixture, said ignition means being partially disposed within said combustion pipe.

2. In combination with a waste heat recovery duct of the type having a grid burner system for raising the temperature of exhaust gases passing through the duct, said grid burner system including a plurality of main burner elements extending inwardly into said duct from at least one duct wall and a pilot burner disposed downstream from said main burner elements and transverse thereto; a pilot burner igniter comprising:

an outer, air supply pipe having an inlet connected to an air supply;

a fuel supply pipe concentrically mounted within said outer air supply pipe, said fuel supply pipe having an inlet connected to a fuel supply;

a combustion pipe concentrically mounted within said air supply pipe and co-axial with said fuel supply pipe;

a nozzle for interconnecting the outlet end of said fuel supply pipe with the inlet end of said combustion pipe, said nozzle having an axi-symmetric mixing chamber for combining said fuel and air into a combustible mixture; said nozzle being formed with a plurality of fuel inlet holes and air inlet holes communicating the mixing chamber with said fuel pipe and said air pipe; respectively; said fuel inlet holes and said air inlet holes being formed substantially tangential with respect to the mixing chamber whereby a circumferential movement is imparted to the fuel and air, respectively; and, ignition means for igniting said combustible mixture in said combustion pipe downstream from said nozzle, said ignition means being located outside said waste heat recovery duct.

* * * * *